United States Patent [19]

Wang et al.

[11] 4,130,422

[45] Dec. 19, 1978

[54] COPPER-BASE ALLOY FOR LIQUID PHASE SINTERING OF FERROUS POWDERS

[75] Inventors: John L. Wang, San Francisco; Milton R. Pickus, Oakland; Meng-Hsiu Chen, San Francisco, all of Calif.

[73] Assignee: The United States of America as represented by the United States Department of Energy, Washington, D.C.

[21] Appl. No.: 807,106

[22] Filed: Jun. 16, 1977

[51] Int. Cl.[2] ..... C22C 1/04; B22F 3/16

[52] U.S. Cl. ..... 75/246; 75/255

[58] Field of Search ..... 75/255, 246, 200, 247

[56] References Cited

U.S. PATENT DOCUMENTS

| | | | |
|---|---|---|---|
| 1,793,157 | 2/1931 | Chapin | 75/255 X |
| 2,456,779 | 12/1948 | Goetzel | 75/200 |
| 3,694,123 | 9/1972 | Farmer | 75/255 X |

FOREIGN PATENT DOCUMENTS 629326 9/1949 United Kingdom.

OTHER PUBLICATIONS

Hirschhorn, J. S., *Introduction to Powder Metallurgy*, Am. Powd. Met. Ins., 1969, pp. 238–245.

Berner, E. et al., *Modern Developments in Powder Met.*, vol. 6, pp. 237–250, 1973.

Smith, C. S. et al., *Trans. A.I.M.E., vol. 147, Inst. of Metals Division, 1942, pp. 222–225.*

*Primary Examiner*—Richard E. Schafer

*Attorney, Agent, or Firm*—Dean E. Carlson; Roger S. Gaither; Irene S. Croft

[57] ABSTRACT

A copper-base alloy composition consisting essentially of 85 – 89% copper, 2 – 4% manganese, and 8 – 11% silicon and use of same in liquid phase sintering of ferrous powders.

12 Claims, 2 Drawing Figures

COPPER-BASE ALLOY FOR LIQUID PHASE SINTERING OF FERROUS POWDERS

BACKGROUND OF THE INVENTION

The invention described herein was made in the course of or under Energy Research and Development Administration Contract No. W-7405-ENG-48 with the University of California.

This invention relates to a copper-base alloy composition and use of same in the production of sintered iron products.

Ferrous powder metallurgy is growing rapidly in importance, particularly for the automotive where ferrous sintered products are finding increasing use as reliable components for structural or functional use.

In the simple process of pressing and sintering, a compact without the presence of some liquid phase can only reach a sintered density of about 90% of theoretical. It has been found that the residual porosity has many deleterious effects on the mechanical properties of parts made by powder metallurgy techniques. Other processes to produce high density parts such as high compacting pressure, forging, hot isostatic pressing, sinter-repress-resinter, and infiltration, are all comparatively higher in cost or involve more elaborate procedures. Thus, the need exists for an improvement in the simple press-sinter techniques to achieve better density and strength.

Copper and copper base alloys have been widely used in the industry either as a base material or as an infiltrant for ferrous components. Mixtures of iron and copper powders are commonly used to produce high strength steel parts. Copper powders, at supersolidus sintering temperatures melt and wet the iron particles and bind them tightly together after solidification. The sintering behavior of Fe + Cu alloys made from mixed elemental powders has been well documented. A disadvantage of copper additions is "copper growth" (swelling) during sintering which reduces the sintered density and dimensional accuracy. The cause and the effect of this phenomenon have been extensively studied. It has recently been proved that the rapid expansion observed at the melting point of copper is caused by the penetration of copper in the boundaries within and between iron particles (D. Berner, H. E. Exner and G. Petzow, "Swelling of Iron-Copper Mixtures During Sintering and Infiltration," *Modern Developments in Powder Metallurgy* 6, 1973).

Thus, the need exists for an improved material which will alloy rapidly during short sintering cycles, will have a beneficial effect on mechanical properties, and will be compatible with existing equipment and practices.

SUMMARY OF THE INVENTION

The present invention provides a low melting copper-base alloy for liquid phase sintering of ferrous powders for the production of sintered ferrous products by powder metallurgy techniques. The Cu-base alloy of this invention is an Intermetallic compound consisting essentially of 85–89% copper, 2–4% manganese, and 8–11% silicon. (Herein, percent composition is given in weight percent unless otherwise specified). This Cu-Mn-Si intermetallic is very brittle so that it can readily be reduced to a fine powder for blending with an iron-base powder, which may be elemental iron powder or an iron powder admixed (including prealloyed) with one or more other elements. In the sintering process, this Cu-Mn-Si intermetallic melts and wets the iron particles so readily that it spreads rapidly over the surfaces of all of the iron particles, thus effectively reducing the diffusion distance to the order of one particle radius.

It is, therefore, an object of this invention to provide a copper-base alloy, particularly for use in liquid phase sintering of ferrous powders.

Another object of this invention is to provide an improved iron powder composition suitable for the production of a sintered ferrous product by liquid phase sintering.

Still another object is to provide an improved method for the production of a ferrous product by liquid phase sintering.

Yet another object of this invention is to provide an improved sintered ferrous product.

Other objects and advantages will become apparent from the following detailed description made with reference to the accompanying drawings.

DETAILED DESCRIPTION OF THE INVENTION

Figure 1:
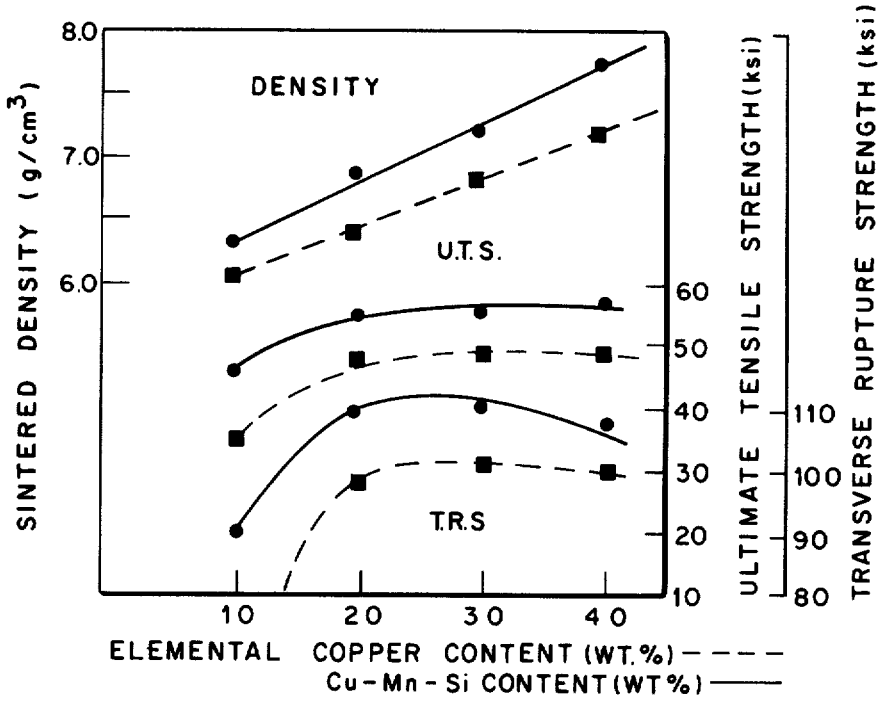
FIG. 1 is a graph comparing the influence of additions of elemental copper and of the present Cu-Mn-Si alloy on sintered iron compacts.

The copper-base alloy of the present invention is an intermetallic compound of copper, manganese, and silicon. An intermetallic compound is defined as an intermediate phase in a binary or higher order metal-metal system whether ordered or disordered; some occur at definite atomic ratios while others exist over an extended composition range. The intermetallic compound of the present invention consists essentially of 85–89% copper, 2–4% manganese, and 8–11% silicon. Trace amounts of other elements may be present as impurities without any significant effect on the properties of the intermetallic; however, for use in liquid phase sintering as hereinafter described, it is preferred that the compound be substantially pure. X-ray diffraction studies have shown that the Cu-Mn-Si alloy of the present invention possesses a crystal structure similar to that of $Cu_3Si$ and, therefore, may be designated by the formula $Cu_3(Mn,Si)$. For brevity, the present composition will be referred to hereinafter as Cu-Mn-Si. Cu-Mn-Si has a melting point of about 780° C.

Cu-Mn-Si is prepared simply by fusing the three elements together in the proper proportions. The resulting product is very brittle and can be easily reduced to a fine powder. Cu-Mn-Si powder is especially useful as an additive to provide a liquid phase during sintering of iron-base powders. For such purposes, a composition of the order of about 88% copper, about 3% manganese, and about 9% silicon is preferred.

For the production of iron powder parts in accordance with the present invention, an iron-base powder such as is commonly used in ferrous powder metallurgy techniques is intimately blended with an amount of the present Cu-Mn-Si powder sufficient to provide a liquid phase during a subsequent sintering (heating) operation. The amount of Cu-Mn-Si powder required is generally of the order of at least about 10% of the total powder blend. The maximum amount of Cu-Mn-Si powder added is dictated by the consideration, well established in the art, that a liquid phase of no more than about 25 vol% can be tolerated during the sintering operation.

The blended powders are then compacted by any one of the compaction techniques well known to those skilled in the art. The major functions of powder compaction are to consolidate the powder into a desired shape and to impart adequate strength for subsequent handling. The resulting green compact is then heated in a protective atmosphere to a high temperature, above the melting point of the Cu-Mn-Si additive but below the melting point of the iron-base powder, preferably in the range of about 1000–1400° C., for a period of time sufficient to produce a substantially fully dense coherent mass. The Cu-Mn-Si additive thus provides a liquid phase during the heating operation. This heating (sintering) technique is referred to in the powder metallurgy art as liquid phase sintering.

It has been found that during heating to the sintering temperature, Cu-Mn-Si melts and wets the iron particles so readily that it spreads rapidly over the surfaces, not only of nearest neighbors, but of all the iron particles. This effectively reduces the diffusion distance to the order of one particle radius. It was also found that during homogenization at the sintering temperature both silicon and manganese preferentially diffused into the iron particles and left behind a ductile copper alloy to serve as a binder. The alloying with both silicon and manganese greatly increases the hardness of the iron particles.

Iron-base powders which can be used as the base material for blending with the Cu-Mn-Si composition of the present invention include elemental iron particles a well as iron particles, admixed (including prealloyed) with one or more elements for imparting desired characteristics to the resulting sintered product. Iron-base alloys have been extensively studied and the specific properties imparted by particular alloying elements as well known to those skilled in the art. A particularly desirable alloying element is carbon. It is well established that the properties of iron-base alloys in general can be vastly extended by heat treatment, and the presence of carbon will facilitate any heat treatment which may be applied to the final sintered product. Both elemental iron particles and prealloyed iron particles normally have associated therewith minor or trace amounts of incidental impurities, such as carbon, sulfur, phosphorus, manganese, silicon, and the like.

It has also been found that optimum mechanical properties of the finished sintered product are obtained when the final product has a total copper content in the range of from about 18 to about 25%. The optimum copper content may be totally supplied by the Cu-Mn-Si additive, but it is preferred that a portion, at least about 8%, of the total copper content be supplied by the use of an iron-copper powder. The contribution of prealloyed or admixed copper to the optimum total copper content is subject to the provision that the blended sintering powder contain sufficient Cu-Mn-Si additive to provide a liquid phase during the sintering operation. A suitable iron-copper powder is a commercially available powder containing about 12% copper, the balance being iron and the incidential impurities normally associated therewith.

The following example is illustrative of the present invention.

EXAMPLE

A Cu-Mn-Si alloy consisting essentially of about 88% copper, about 3% manganese, and about 9% silicon was cast into an ingot which was crushed and then ball milled to 1 ~ 8μ size. X-ray examination showed the alloy to be an intermetallic compound with a structure similar to $Cu_3Si$. The compound had a silvery luster and was very brittle. The measured density was 7.85g/cm$^3$. The melting point of the compound was 780° C.

Characteristics of the elemental iron powder and the preinfiltrated iron-copper powder used are shown as manufacturer's data in Table 1.

TABLE 1

| | | Elemental Fe* | Preinfiltrated Fe** |
|---|---|---|---|
| Chemical analysis (wt. %) | Cu | 0 | 11.86 |
| | C | 0.01 | 0.02 |
| | S | 0.01 | 0.012 |
| | P | 0.005 | 0.01 |
| | Mn | 0.2 | 0 |
| | Si | 0.02 | 0 |
| | Fe | Balance | Balance |
| $H_2$ | loss | 0.12 | 0.67 |
| Screen Analysis | | % | % |
| | −80+100 | 2.0 | 6.3 |
| | −100+150 | 14.0 | 19.2 |
| | −150+200 | 22.0 | 23.8 |
| | −200+250 | 10.0 | 11.4 |
| | −250+325 | 22.0 | 11.1 |
| | −325 | 30.0 | 28.2 |
| Apparent Density | | 2.95 g/cm$^3$ | 2.91 g/cm$^3$ |
| Flow time | | 25 sec/50g | 24.5 sec/50g |

*EMP atomized, grade 300M A.O. Smith Co.
**Prefiltron 12, Pfizer Inc.

Carefully weighed powders, together with alumina pellets, were contained in glass jars and tumble blended for sixty minutes. The alumina pellets sufficiently broke up agglomerated powders and aided in producing a uniform powder mixture. After blending, each mixture of powders was pressed in a double acting steel die, using a hydraulic press. Every compact was held under pressure over two minutes to allow for outgassing. All die surfaces were lubricated before each compacting process. The lubricant used was a mixture of 100g of zinc stearate in 1 liter of 1,1,1-trichloroethane.

All samples after compacting were sintered in a purified hydrogen atmosphere. A volume displacement method was used to measure the volume and density of the green or sintered compacts.

Sintered tensile test bars conforming to MPIF standard 10–63 were tested with an Instron testing machine using a crosshead speed of 0.05 cm/min. ASTM standard E8 was used to choose gripping devices and methods of determining tensile strength and elongation. Transverse rupture test bars conforming to MPIF standard 13–62 were also tested with the Instron testing machine using a three point bending fixture. A Leitz Wetzlar miniload hardness tester was used to determine the hardness of the sintered parts.

A good densification result of 99% of the theoretical density was achieved by sintering: (1) EMP Fe and 30% Cu-Mn-Si at 1050° C. for 4 hours in a $H_2$ atmosphere; (2) EMP Fe and 40% Cu-Mn-Si at 1150° C. for 1 hour; (3) EMP Fe and 30% Cu-Mn-Si at 1350° C. for 5 minutes, or (4) preinfiltrated powder and 10% Cu-Mn-Si at 1150° C. for 1 hour. It was found that densification occurred most effectively at a sintering temperature of about 1150° C.

Figure 2:
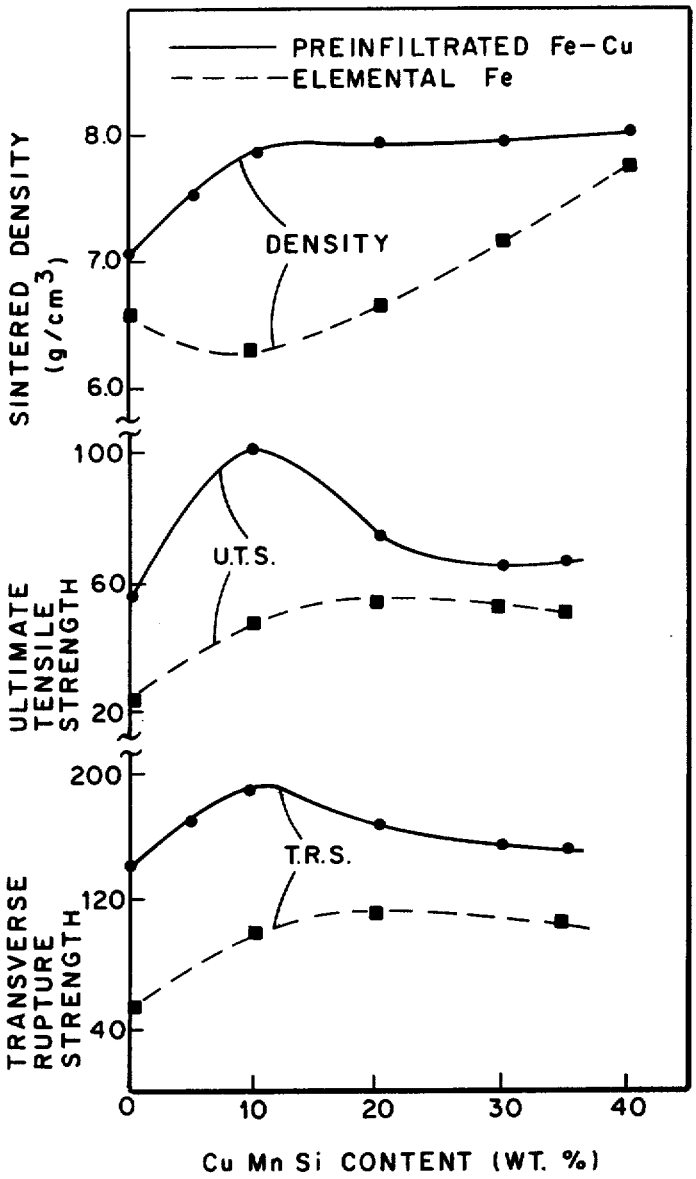
FIG. 2 is a graph showing the influence on sintered properties of additions of the present Cu-Mn-Si alloy to unalloyed iron and to preinfiltrated iron-copper powders.

The effect of additions of Cu-Mn-Si to both elemental iron powder and the preinfiltrated iron-copper powder on the sintered density, tensile strength and transverse rupture strength of specimens sintered for 1 hour at 1150° C. is shown graphically in FIG. 2. All of the mechanical properties reached an optimum at about 20% total copper content.

For purposes of comparison, the effect of the addition to unalloyed iron powder of pure copper on sintered density, tensile strength and transverse rupture strength was also determined. The results are shown in FIG. 1 in comparison with the effect of Cu-Mn-Si additions to unalloyed iron powder. Clearly, additions of Cu-Mn-Si have a strongly beneficial effect, compared with additions of elemental copper, on the mechanical properties of sintered ferrous products. Moreover, the improvement is even more dramatic if iron powder admixed with copper, (e.g., by preinfiltration or prealloying) is used as a base. In the latter case, densities over 98% of theoretical and tensile strengths of 100 KSI are readily achieved by simply pressing and sintering.

It was found that during sintering, diffusion and solution-precipitation took place. Both silicon and manganese preferentially diffused into the iron particles and left behind a ductile copper alloy to serve as a binder. The alloying with both silicon and manganese greatly increased the hardness of the iron particles as shown in Table 2.

Table 2

Microhardness Before and After Sintering.

| Material | Hardness (VH - 50 Gram Load) Before Sintering | After Sintering (½ hour, 1175° C) |
|---|---|---|
| Cu—Mn—Si | 678 | 106 |
| Iron | ~64 | 465 |

Thus, the final sintered compact consisted of hardened Fe particles bonded by a soft copper base matrix. This is a desirable structure for parts as-sintered and a good base structure for further forging or additional processing.

The as-sintered products obtained by the present invention may be subject to additional processing, in particular heat treatment according to conventional practice for the purpose of enhancing mechanical properties.

Thus, there is provided by this invention a material which is useful as an additive to provide a liquid phase during sintering of iron-base powders and which has a strongly beneficial effect on the mechanical properties of the sintered ferrous product.

Although the present invention has been hereinbefore described with reference to specific examples, various changes and modifications falling within the true spirit of the invention will be obvious to those skilled in the art, and it is not intended to limit the invention except by the terms of the following claims.

What we claim is:

1. A powder mixture for the production of a sintered ferrous product comprising an iron-base powder and a copper-base intermetallic compound consisting essentially of about 85–89% copper, about 2–4% manganese, and about 8–11% silicon in an amount sufficient to provide a liquid phase at the material sintering temperature.

2. A powder mixture according to claim 1 wherein the amount of copper-base intermettallic compound is at least 10% of the mixture.

3. A powder mixture according to claim 1 wherein the copper base intermetallic compound consists essentially of about 88% copper, about 3% manganese, and about 9% silicon.

4. A powder mixture according to claim 1 wherein the iron-base powder is selected from elemental iron powder and an iron-copper powder.

5. A powder mixture according to claim 4 wherein the iron-base powder is an iron-copper powder.

6. A powder mixture according to claim 1 wherein the total copper content of the mixture is in the range of from about 18% to about 25%.

7. A powder mixture according to claim 6 wherein the iron-base powder is an iron-copper powder containing sufficient copper to provide at least about 8% of the total copper content.

8. A sintered ferrous product produced by liquid phase sintering of a powder mixture as defined in claim 1, said sintered product consisting essentially of iron-base particles enriched in manganese and silicon and bonded by a copper-base matrix depleted in manganese and silicon.

9. A sintered ferrous product according to claim 8 wherein the powder mixture contains at least 10% of the copper-base intermetallic compound.

10. A sintered ferrous product according to claim 8 wherein the copper-base intermetallic compound consists essentially of about 88% copper, about 3% manganese, and about 9% silicon.

11. A sintered ferrous product according to claim 8 wherein the total copper content is in the range of from about 18% to about 25%.

12. A sintered ferrous product according to claim 11 wherein the iron-base powder is an iron-copper powder containing sufficient copper to provide at least about 8% of the total copper content.

* * * * *